US007245264B2

(12) United States Patent
Sakakibara et al.

(10) Patent No.: US 7,245,264 B2
(45) Date of Patent: Jul. 17, 2007

(54) HIGH FREQUENCY MODULE AND ARRAY OF THE SAME

(75) Inventors: Kunio Sakakibara, Nagoya (JP); Yutaka Aoki, Nisshin (JP)

(73) Assignees: DENSO Corporation, Kariya (JP); National University Corporation Nagoya Institute of Technology, Nagoya (JP)

( * ) Notice: Subject to any disclaimer, the term of this patent is extended or adjusted under 35 U.S.C. 154(b) by 0 days.

(21) Appl. No.: 11/393,035

(22) Filed: Mar. 30, 2006

(65) Prior Publication Data

US 2006/0220974 A1 Oct. 5, 2006

(30) Foreign Application Priority Data

Mar. 31, 2005 (JP) ..... 2005-104294

(51) Int. Cl.
*H01Q 13/00* (2006.01)

(52) U.S. Cl. ..... 343/772; 343/786

(58) Field of Classification Search ..... 343/771, 343/772, 786, 753
See application file for complete search history.

(56) References Cited

U.S. PATENT DOCUMENTS

| | | | | |
|---|---|---|---|---|
| 5,426,442 | A * | 6/1995 | Haas | 343/778 |
| 5,760,397 | A | 6/1998 | Huguenin et al. | |
| 5,861,839 | A | 1/1999 | Upton et al. | |
| 6,075,493 | A | 6/2000 | Sugawara et al. | |
| 6,587,246 | B1 | 7/2003 | Anderton et al. | |
| 6,768,401 | B2 * | 7/2004 | Koriyama | 333/248 |
| 2003/0122724 | A1 * | 7/2003 | Shelley et al. | 343/786 |

FOREIGN PATENT DOCUMENTS

| | | |
|---|---|---|
| JP | 06-331725 | 12/1994 |
| JP | 09-027927 | 1/1997 |
| JP | 11-330846 | 11/1999 |
| JP | 2003-198943 | 7/2003 |
| JP | 2004-093382 | 3/2004 |

OTHER PUBLICATIONS

G.M. Rebeiz, D.P. Kasilingam, Y. Guo, P.A. Stimson, D.B. Rutledge, "Monolithic Millimeter-Wave Two-Dimensional Horn Imaging Arrays", IEEE Transactions on Antennas and Propagation, vol. 38, No. 9, Sep. 1990.

* cited by examiner

*Primary Examiner*—Tan Ho
(74) *Attorney, Agent, or Firm*—Harness, Dickey & Pierce, PLC

(57) ABSTRACT

A high frequency module for converting a high frequency wave in a free space to a high frequency wave in a planar waveguide includes two metal plates, a dielectric substrate and a planar waveguide disposed on the dielectric substrate. The dielectric substrate between the two metal plates has the planar waveguide disposed thereon, and the planar waveguide protrudes either in a through hole bored in one of the two metal plates, or in a hollow space defined by the other of the two metal plates on the dielectric substrate.

16 Claims, 10 Drawing Sheets

HIGH FREQUENCY MODULE AND ARRAY OF THE SAME

CROSS REFERENCE TO RELATED APPLICATION

This application is based on and claims the benefit of priority of Japanese Patent Application No. 2005-104294 filed on Mar. 31, 2005, the disclosure of which is incorporated herein by reference.

FIELD OF THE INVENTION

The present invention generally relates to a high frequency module.

BACKGROUND OF THE INVENTION

In recent years, demand for use of communication systems that use high frequency waves is increasing. The high frequency communication systems utilizes a millimetric-wave, and the high frequency communication systems cover frequency band of a broad range, thereby being designated as an Ultra Wide-Band system or the like. In addition, demand for passive millimetric-wave imaging systems is also increasing in an area of sensing system.

In the course of developing the millimetric-wave sensing systems, an antenna for covering the broad band and electric circuits for signal processing are required. The antenna for the broad band is, for example, a waveguide type antenna (a horn antenna). The electric circuit for the signal processing is, for example, a microstrip type circuit. The millimetric-wave captured by the horn antenna is sent to a waveguide-microstrip conversion system before being supplied to the microstrip type circuit.

Conventional millimetric-wave antennas and related circuits for the broad band are disclosed in Japanese Patent Documents JP-A-H11-163636 and JP-A-H11-330846. The antenna disclosed in these documents are planar antennas, and the planar antennas can be formed on the same substrate as the circuit for millimetric-wave detection. Therefore, there is no need for the planar antenna to have the waveguide-microstrip conversion system that is conventionally required for waveguide antennas.

In addition, it is disclosed in IEEE Transactions on Antennas and Propagation Vol. 38, No. 9, September 1990, pp 1473-1482, as another technology of combination of the waveguide horn and the planar antenna. In this structure, the planar antenna has the shape of a horn antenna and a membrane (a film) is established in the horn antenna perpendicularly in a propagation direction of a millimeter wave. In this manner, compactness of a depth direction of the structure is substantiated.

However, the technology disclosed in Japanese Patent Documents JP-A-H11-163636 and JP-A-H11-330846 uses the antenna of an end-fire type that has a great dimension in a direction of depth of the waveguide. Therefore, the high frequency module with the end-fire type antenna has to be housed in a long package of a receiver unit, thereby preventing downsizing of the package.

SUMMARY OF THE INVENTION

In view of the above-described and other problems, the present invention provides a high frequency module that has a simple and robust construction with a wide range of frequency reception capability and compactness. An array of the high frequency module is also within a scope of provision of the present invention.

The high frequency module of the present invention for converting high frequency wave in a free space to high frequency wave in a planar waveguide includes two metal plates, a dielectric substrate and a planar waveguide disposed on the dielectric substrate. The dielectric substrate is bound by the two metal plates, and one of the two metal plates has a through hole from outer surface toward the dielectric substrate. The dielectric substrate has the waveguide on the other metal plate side, and an end of the waveguide is positioned in a projection area of the through hole on the other metal plate side surface of the dielectric substrate.

High frequency wave in the free space captured by the through hole of the high frequency module permeates through the dielectric substrate to the metal plate on the other side of the through hole. The high frequency wave reflected on the metal plate creates a standing wave. The planar waveguide is so positioned that an end of the waveguide catches a maximum amplitude of the high frequency wave. In this manner, a weak high frequency wave transmitted in the free space is converted to the high frequency wave in the planar waveguide efficiently in a wide range of frequency. In addition, the high frequency module of the present invention has compactness compared to a conventional high frequency module because of a plate-like shape of its components.

Further, the planar waveguide may be disposed on the same side of the substrate as the through hole. This construction of the high frequency module has a same effect as the frequency module described first in the summary section.

The planar waveguide is, for example, a slot waveguide, a co-planar wave guide, or a tri-plate type waveguide. In this case, the microstrip waveguide is especially suitable for the high frequency module because the structure of the microstrip waveguide has an advantage in terms of positioning the end of the waveguide at the maximum amplitude position of the standing wave with relative ease. The end of the waveguide may be positioned in a projection area of the through hole on an opposited side or on the same side of the dielectric substrate as the through hole. In this manner, the highly efficient and broad frequency band conversion of the high frequency wave is achieved by the high frequency module of the present invention.

Further, the position of the microstrip waveguide is preferably shifted by a predetermined amount from a center of the through hole. That is, the end of the through hole is preferably shifted from the center of the through hole in a direction perpendicular to the longitudinal side of the microstrip waveguide by the predetermined amount. In other words, a center axis of the through hole and the longitudinal direction of the microstrip waveguide does not cross in a same plane after the shift of the microstrip waveguide with the longitudinal direction kept in parallel with the dielectric substrate. In this manner, the frequency range of the convertible high frequency wave can be increased by adjusting the amount of the shifting for matching impedances between the antenna (the through hole in the metal plate) and the microstrip waveguide.

The amount of the shift of the microstrip waveguide is preferably 10 to 15% of he width (an inside dimension) of the through hole measured in the direction of the shift.

Furthermore, the through hole in the metal plate preferably has a trumpet shape, that is, an increasingly widened shape in terms of the inside dimension of the through hole as a distance from the dielectric substrate increases. The increase of the inside dimension starts at a predetermined distance from the dielectric substrate. In this manner, the high frequency module of the present invention has an increased range in terms of frequency characteristics, owing to a same effect that is achieved by a horn antenna.

Furthermore, the high frequency module preferably has a hollow space on the opposite side of the substrate relative to the through hole. The hollow space is preferably positioned in a projection area of the through hole on the substrate, and an opening of the hollow space is preferably covered by the substrate. In this manner, the high frequency wave is reflectively resonated in the hollow space to have a high efficiency of conversion characteristics.

The hollow space is preferably in a rectangular shape having the same cross-sectional shape as the through hole when taken in parallel with the substrate. A shorter side of the rectangular shape is preferably aligned with the longitudinal direction of the microstrip waveguide. In addition, the high frequency wave having a polarized wave surface in parallel with the shorter side of the rectangular shape can selectively captured by the antenna, thereby improving the conversion efficiency.

The opening of the hollow space preferably has a wall portion protruding from an opposite side of the microstrip waveguide. That is, the waveguide and the wall portion respectively protrude from the opposite sides into the hollow space. The opening of the hollow space is partially covered by the wall portion. In this manner, the convertible frequency range can be increased by adjusting the amount of the protrusion of the wall portion for matching the impedances between the antenna and the planar waveguide. In addition, the reflection of the high frequency wave on the inside surface of the wall portion contributes to the improvement of the conversion efficiency.

The amount of the protrusion of the wall portion is preferably 30 to 40% of the length of the shorter side of the rectangular shape of the opening of the hollow space.

Furthermore, the high frequency module preferably has a detection circuit for the high frequency wave, and the detection circuit is preferably connected to the other end of the planar waveguide. In this manner, the high frequency module can output a detected signal as a single unit.

Furthermore, the high frequency module may be arranged in an array with the opening of the through hole of each module oriented in a predetermined direction. In this manner, the directivity of the module is improved and the gain of the output signal is also improved. In addition, imaging based on the output signal from the high frequency module is possible.

Furthermore, a convex shape dielectric lens is preferably positioned at a proximity of the opening of the through hole. The position of the lens is preferably aligned with the orientation of the holes of the modules. The dielectric lens may cover all of the module as a single unit, or each of the holes may respectively be covered by the dielectric lens. In this manner, spherical waves or cylindrical waves can effectively be converted to planar waves, thereby enabling the high frequency module to effectively capture the high frequency wave by using the planar waveguide.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

Embodiments of the present invention are described with reference to the drawings. The embodiments of the present invention are merely presented as exemplary implementation, and do not impose any limitation on the scope of the technology of the present invention.

Premise of the present invention is first described. That is, as defined in Plank's law of radiation, any object radiates electromagnetic wave determined by the temperature, the material of its surface and the like. Peak electric power of the electromagnetic wave radiation exists in an infrared light area. However, weak electromagnetic wave radiation exists in a millimetric wave range and in a microwave range. The electromagnetic wave radiation in the millimetric wave range is represented in a following equation (Equation 1: Rayleigh-Jean approximation)

$$P=k\Delta f(\epsilon T)[W] \quad \text{[Equation 1]}$$

In the Equation 1, k [J/K] is a Boltzmann constant, Δf [Hz] is a wave range of observation, T [K] is a physical temperature of a target object, and ϵ is an emissivity.

In recent years, a passive millimetric wave image sensor is more popularly used for detecting a shape of an object. The millimetric wave used in the passive millimetric wave image sensor has greater penetration probability through a fog compared to a visible light, and the image sensor is expected to serve as a sensing device in all weather.

As clearly shown in the Equation 1, the electric power of the radiation is extremely weak. For example, the electric power of radiation from a blackbody at the temperature of 300 [K] (emissivity=1) equals to 4 [pW] per 1 [GHz].

Also shown in the Equation 1, the electric power of the radiation is proportionally dependent on a width of observation range. Therefore, the image sensor has to have a broad reception range in order to receive a greater electric power. That is, the passive millimetric wave image sensor has to process broad range of radio frequency in a receiver unit of the sensor.

Further, the passive millimetric wave image sensor generally having a large package size creates a high demand of the image sensor housed in a small package. The embodiment of the present invention discloses a passive millimetric wave image sensor that covers a broad band and is contained in a small package for use in high frequency modules.

First Embodiment

Figure 1:
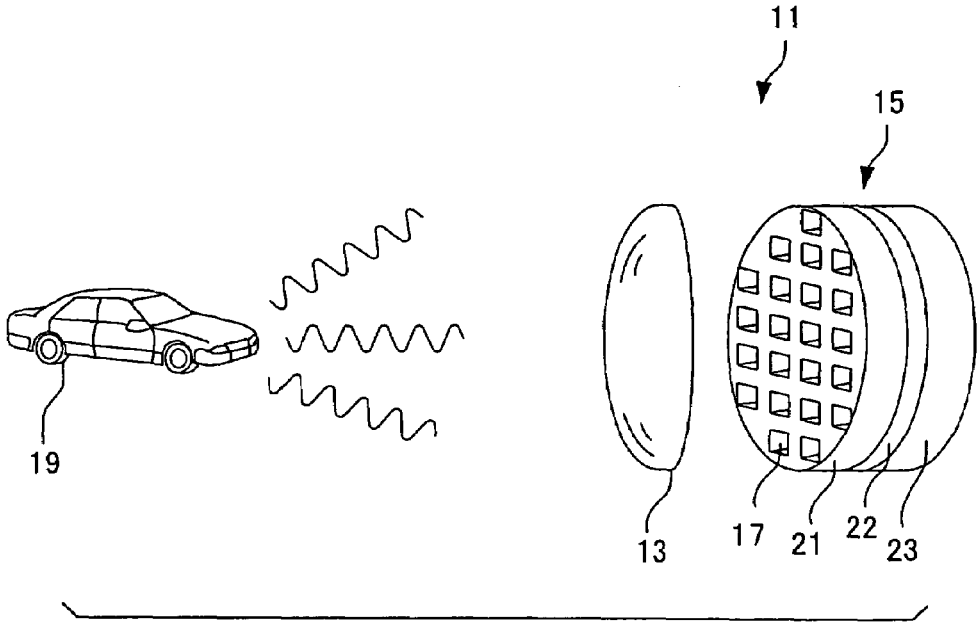
FIG. 1 shows an illustration array of high frequency modules in a first embodiment of the present invention.

FIG. 1 shows an illustration of an array of the high frequency modules 11 and an object of detection by the module array 11 (a vehicle 19). The module array 11 includes a convex dielectric lens 13 and an array portion 15. The electric power of the radiation from the vehicle 19 in the millimetric wave range (high frequency wave) is received by each of the high frequency module 17 in the array portion 15 through the dielectric lens 13.

The dielectric lens 13 is a dielectric body in a convex shape (e.g., a polyethelene). The thickness of the lens is preferably determined based on the reflaction index of the dielectric body, a distance of the detecting object from the array portion 15. More practically, the thickness of the lens is preferably determined so that the high frequency wave radiated from the detecting object is converted to a plane wave by the lens.

The array portion 15 includes a plurality of the high frequency modules having opening portions of the modules aligned to a predetermined direction. The high frequency module itself mainly includes metal plates 21, 23 in a disk shape and a dielectric substrate 22 bound by the metal plates 21, 23.

Figure 2A:
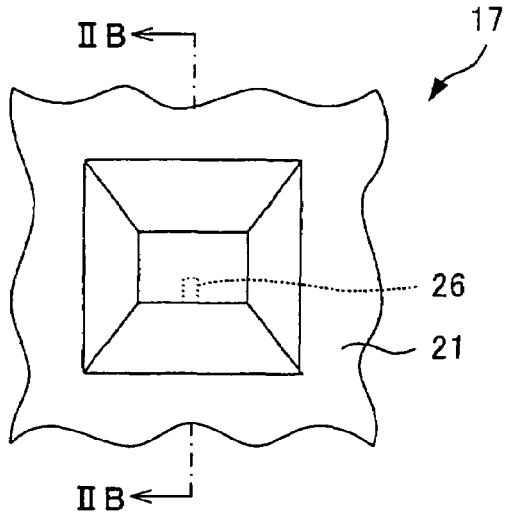
FIG. 2A shows a front view of the high frequency module in the first embodiment.

Details of the high frequency module is described with reference to FIGS. 2A to 2C. That is, FIG. 2A is a front view (seen from the dielectric lens side), FIG. 2B is a cross section taken along IIB-IIB line in FIG. 2A, and FIG. 2C is a cross section taken along IIC-IIC line in FIG. 2B.

Figure 2B:
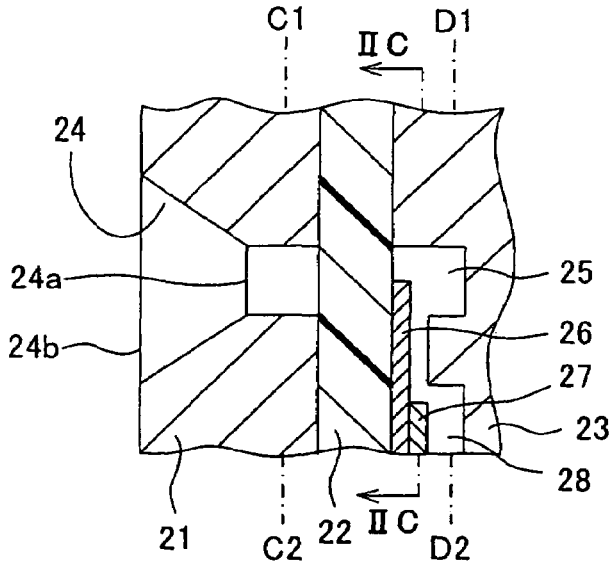
FIG. 2B shows a cross-sectional view of the high frequency module along IIB-IIB line in FIG. 2A in the first embodiment.
Figure 2C:
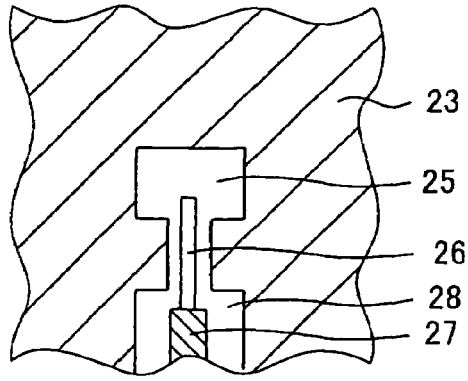
FIG. 2C shows a cross-sectional view of the high frequency module along IIC-IIC line in FIG. 2B. in the first embodiment.

In FIG. 2B, the high frequency module 17 includes a microstrip waveguide 26 and a high frequency circuit 27 beside the metal plates 21, 23 and the dielectric substrate 22.

The metal plate 21 has a through hole 24. A cross section of the through hole 24 by a plane in parallel with the substrate 22 (i.e., a line C1-C2) is in a same rectangular shape (e.g., inside dimensions of the hole are, for example, 3.1 mm in a longer side and 1.55 mm in a shorter side) in a portion from the dielectric substrate 22 to a predetermined position 24*a*, and is in an increasingly expanded rectangular shape (e.g., 9.4 mm in a longer side and 6.6 mm in a shorter side at an opening portion 24*b*). Therefore, the hole 24 serves as a horn type waveguide antenna having a straight portion.

The metal plate 23 has a hollow space 25 on an opposite side of the hole 24 relative to the substrate 22. The hollow space 25 is in a shape of a rectangular parellelepiped. The cross section of the hollow space along a line D1-D2 has a same shape as the cross section of the hole 24 along the line C1-C2.

The metal plate 23 has a cavity 28 that starts at the hollow space 25 toward a downside in FIG. 2B along the substrate 22. The inside dimensions of the cavity 28 allow the microstrip waveguide 26 to be included therein without interference.

The dielectric substrate 22 has the microstrip waveguide 26 and the high frequency circuit 27 disposed thereon on the metal plate 23 side.

The microstrip waveguide 26 disposed on the substrate 22 has an end that protrudes into the hollow space 25. The position and the length of protrusion are preferably determined so that the end of the microstrip waveguide 26 is positioned at a maximum amplitude of a standing wave that is generated by reflection of the high frequency wave entered into the hollow space 25.

The high frequency circuit 27 includes a wave detection circuit and the like, and is connected to the microstrip waveguide 26 for generating an output signal upon receiving the high frequency wave from the microstrip waveguide 26.

The high frequency module array 11 made up from the modules 17 has an increased sensitivity to the high frequency wave originally radiated from the vehicle 19 and entered into the hole 24 through the dielectric lens 13, because the high frequency wave is converted to the plane wave by the lens 13 and generates the standing wave in the hollow space 25 after reflection on an inside wall thereof, whose maximum amplitude is positioned to be captured by the end of the microstrip waveguide 26. In this manner, a weak high frequency wave can be highly efficiently detected and converted to the output signal.

The module array 11 can also be reduced in size because of the disk shape of the components such as the metal plates 21, 23 and the substrate 22. That is, the thickness of those components in an axial direction can be reduced in size compared to a conventional modules.

The cross section of the hole 24 is in a rectangular shape, thereby enabling selective capture of the high frequency wave having a polarized wave front in parallel with the shorter side of the rectangular shape. In this manner, the polarized wave front and a longitudinal direction of the microstrip waveguide 26 is aligned to yield and improved conversion efficiency.

Second Embodiment

A second embodiment of the present invention is described with reference to the drawings. The microstrip waveguide 26 of the module 17 in the second embodiment is shifted in terms of protrusion position into the hollow space 25 compared to the first embodiment. That is, the protrusion position is shifted from a center of the hole 24 and the hollow space 25 when seen from the front side of the module 17.

Figure 3A:
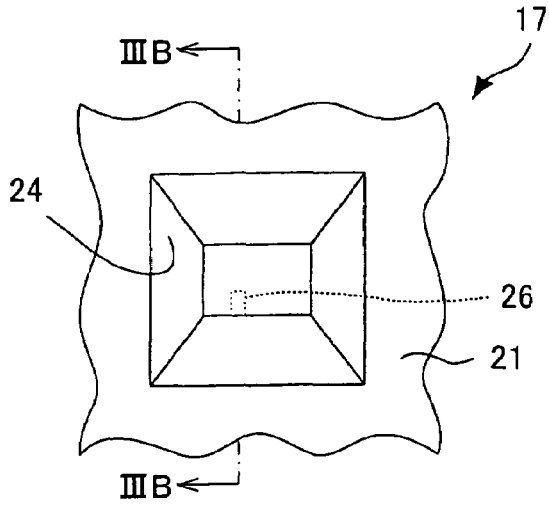
FIG. 3A shows a front view of the high frequency module in the second embodiment.
Figure 3B:
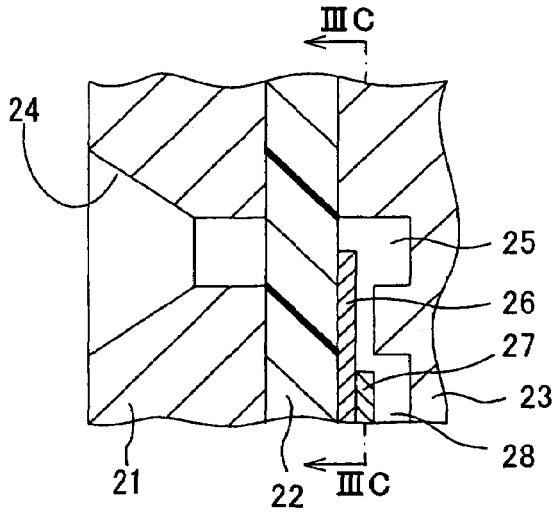
FIG. 3B shows a cross-sectional view of the high frequency module along IIIB-IIIB line in FIG. 3A in the second embodiment.
Figure 3C:
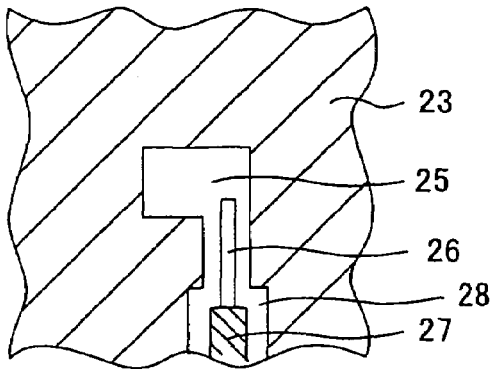
FIG. 3C shows a cross-sectional view of the high frequency module along IIIC-IIIC line in FIG. 3B. in the second embodiment.

FIGS. 3A to 3C are used to describe the position of the microstrip waveguide 26 in the second embodiment. That is, FIG. 3A shows a front view of the high frequency module in the second embodiment, and FIG. 3B shows a cross-sectional view of the high frequency module along IIIB-IIIB line in FIG. 3A in the second embodiment. FIG. 3C shows a cross-sectional view of the high frequency module along IIIC-IIIC line in FIG. 3B. in the second embodiment.

Figure 6:
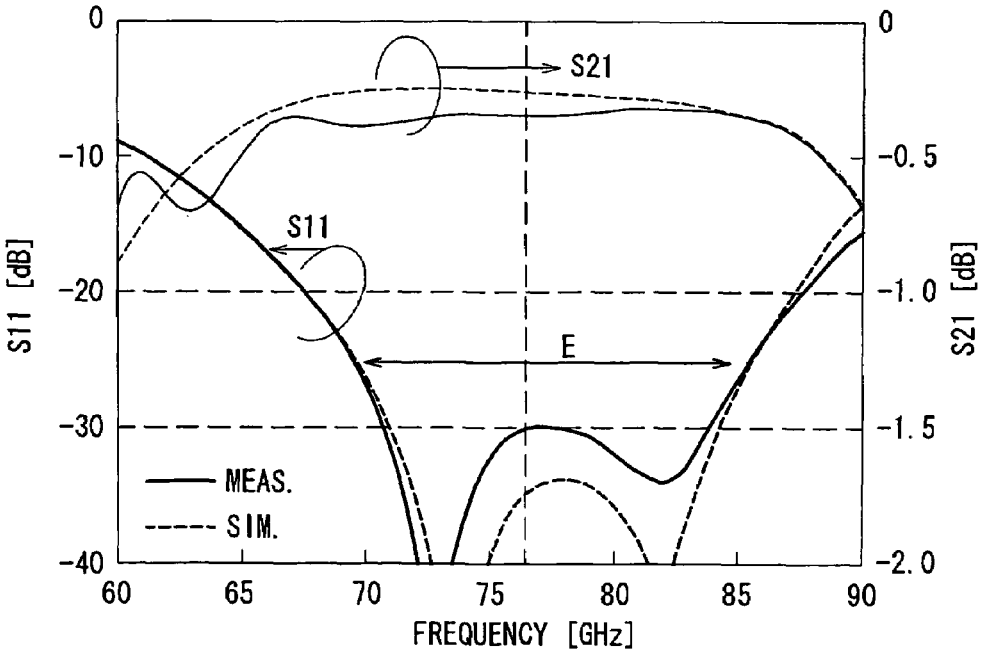
FIG. 6 shows a diagram of simulation result and measurement in an experiment regarding reflectance characteristics and permeation characteristics of a high frequency module in the second embodiment.

The amount of the shift is described based on the reflectance characteristics and permeation characteristics. FIG. 6 shows a diagram of simulation result and measurement in an experiment regarding the reflectance characteristics (S11) and the permeation characteristics (S21) of the high frequency module 17 in the second embodiment. The reflectance characteristics in this context is an input/output ratio of the reflected wave corresponding to a certain range of frequency when the high frequency wave is introduced into the hole 24 from the front side of the module 17. The ratio is low when energy loss during the reflection is low. The permeation characteristics is the input/output ratio of the high frequency wave permeated through the dielectric substrate 22 and the metal plates 21, 23 corresponding to a certain range of frequency when the high frequency wave is introduced in the hole 24 from the front side of the module 17. A diagram in FIG. 6 shows that there are two major plunges, i.e., steep decreases, of the input/output ratio (at a proximity of 73 GHz and a proximity of 82 GHz) in a curve S11. The frequency range for the decreased input/output ratio (indicated by an arrow E in FIG. 6) is widened when there are two plunges compared to one plunge in the diagram. Therefore, the high frequency module 17 is preferably constructed to yield the characteristics of the input/output ratio having two plunges in the diagram.

Figure 7A:
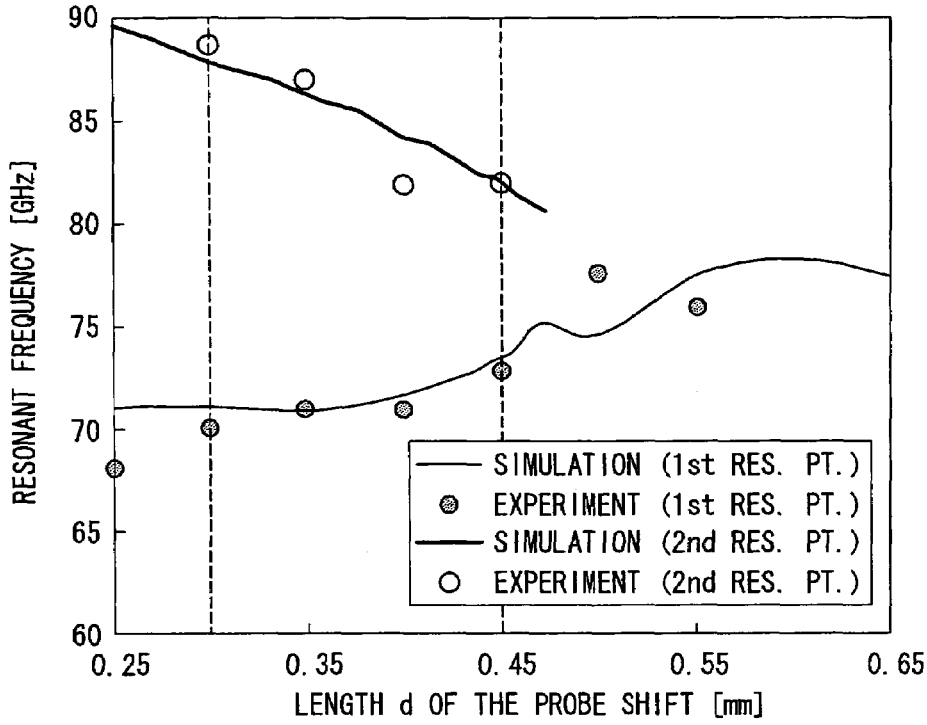
FIG. 7A shows a diagram of simulation result and measurement in an experiment regarding relationship between length of probe shift of a microstrip waveguide and resonance frequency in the second embodiment.
Figure 7B:
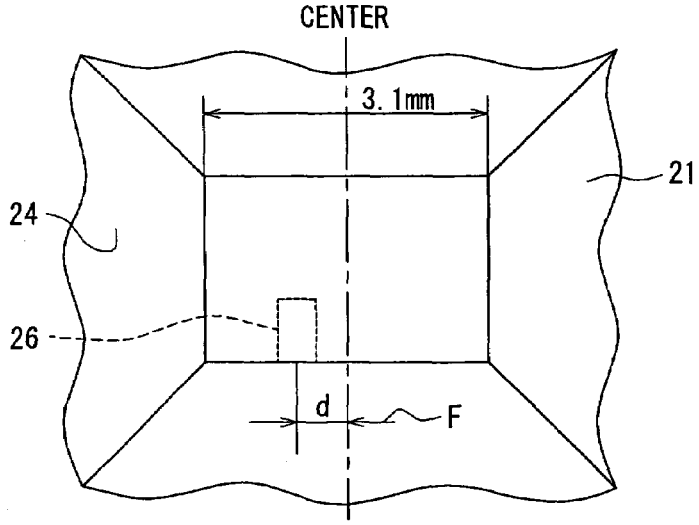
FIG. 7B shows an expanded front view of the high frequency module shown in FIG. 3A.

FIG. 7A shows a diagram of simulation result and measurement in an experiment regarding relationship between length of probe shift of a microstrip waveguide 26 and resonance frequency in the second embodiment, and FIG. 7B shows an expanded front view of the high frequency module 17 shown in FIG. 3A. In this case, the longer side of the hole 24 is 3.1 mm at a bottom, and the shift of the microstrip waveguide 26 is 'd' indicated by an arrow F in the figure.

As clearly shown in FIG. 7A, two resonance points appear in the diagram when the range of the shift d is between 0.30 mm and 0.45 mm. The input/output ratio of the reflected wave has an increased frequency range of intensity lowering when the amount of the shift d is within this range.

Figure 8:
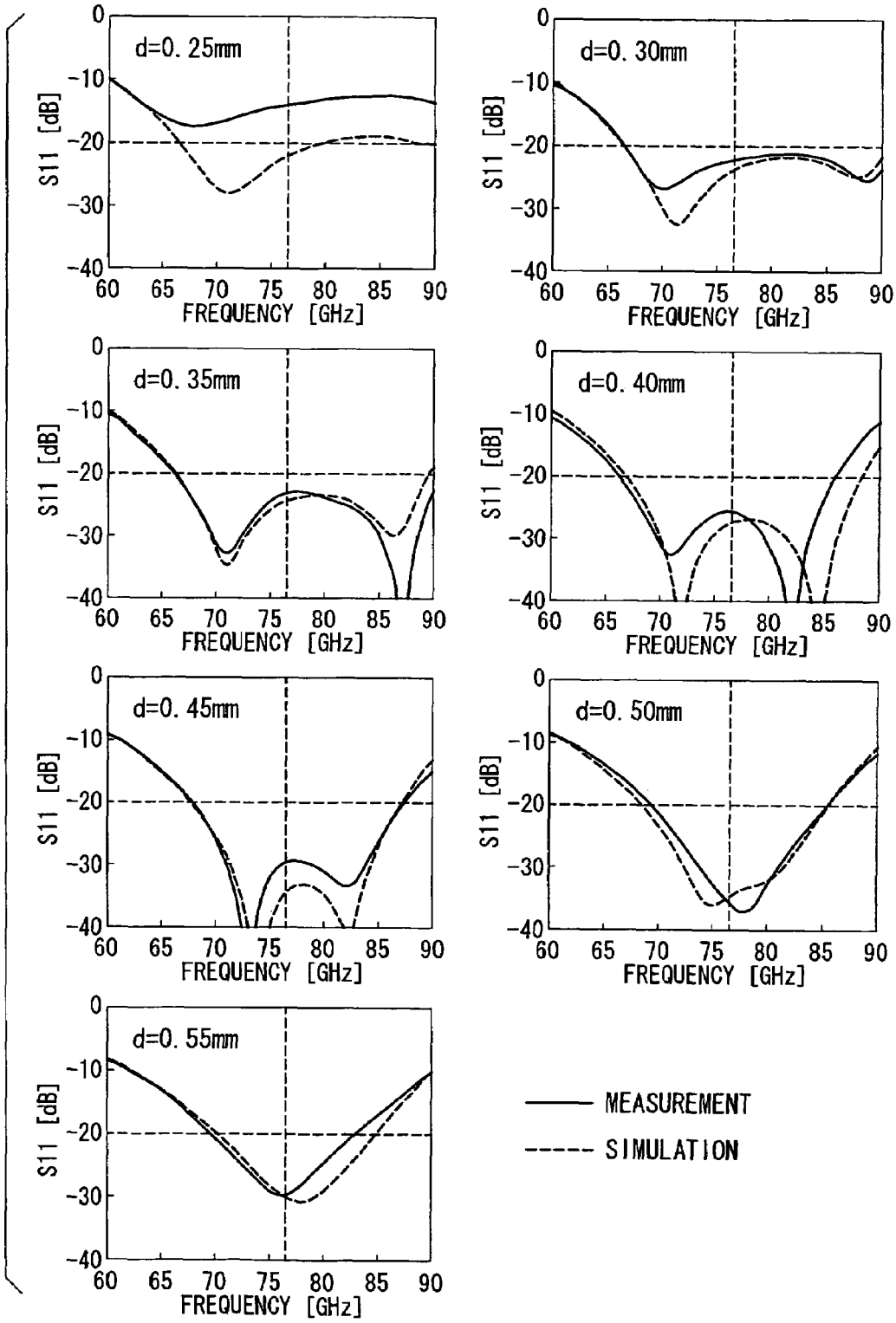
FIG. 8 shows diagrams of simulation result and measurement in an experiment regarding reflectance characteristics of the microstrip waveguide sampled at discreet amounts of probe shift.

Further, as shown by the diagrams of simulation result and measurement in FIG. 8, the range of frequency band having the input/output ratio of under −20 dB is relatively broad when the shift d is in a range between 0.30 mm and 0.45 mm.

As a result, the shift of the microstrip waveguide 26 from the center of the hollow space 25 approximately 10 to 15% relative to the longitudinal length of the longer side serves for providing a highly efficient high frequency module 17, because of the reduction of the energy loss in reflection.

Third Embodiment

Figure 4A:
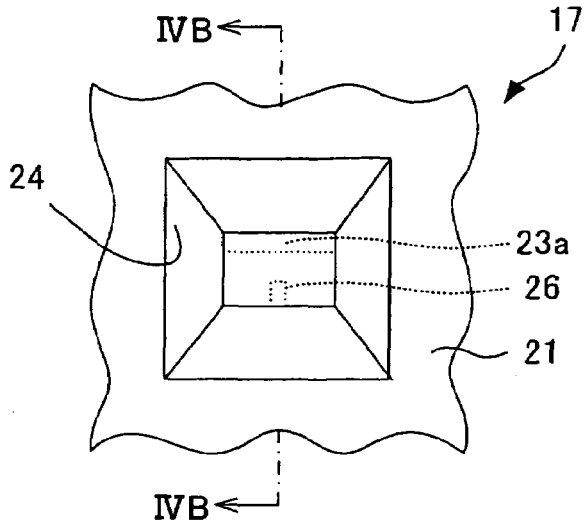
FIG. 4A shows a front view of the high frequency module in the first embodiment.

A third embodiment of the present invention is described with reference to the drawings. That is, FIG. 4A shows a front view of the high frequency module in the third embodiment, FIG. 4B shows a cross-sectional view of the high frequency module along IVB-IVB line in FIG. 4A in the third embodiment, and FIG. 4C shows a cross-sectional view of the high frequency module along IVC-IVC line in FIG. 4B. in the third embodiment.

Figure 4B:
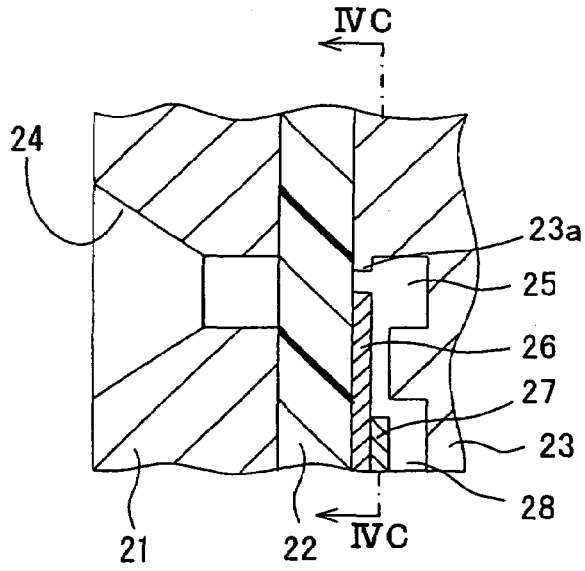
FIG. 4B shows a cross-sectional view of the high frequency module along IVB-IVB line in FIG. 4A in the third embodiment.
Figure 4C:
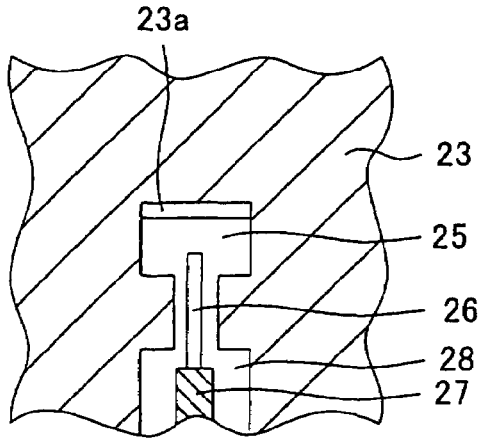
FIG. 4C shows a cross-sectional view of the high frequency module along IVC-IVC line in FIG. 4B. in the third embodiment.

As clearly shown in FIG. 4B, the third embodiment is characterized by a wall portion 23*a* disposed at an opening of the hollow space 25 in the metal plate 23, the opening covered by the dielectric substrate 22.

The wall portion 23*a* is in a shape of a rectangular parallelepiped, and is disposed at the opening on an opposite side of protrusion of the microstrip waveguide 26. The longitudinal length of the wall portion 23*a* is a same length as the longer side of the opening of the hollow space 25. The wall portion is made of a same material as the metal plate 23.

Figure 9A:
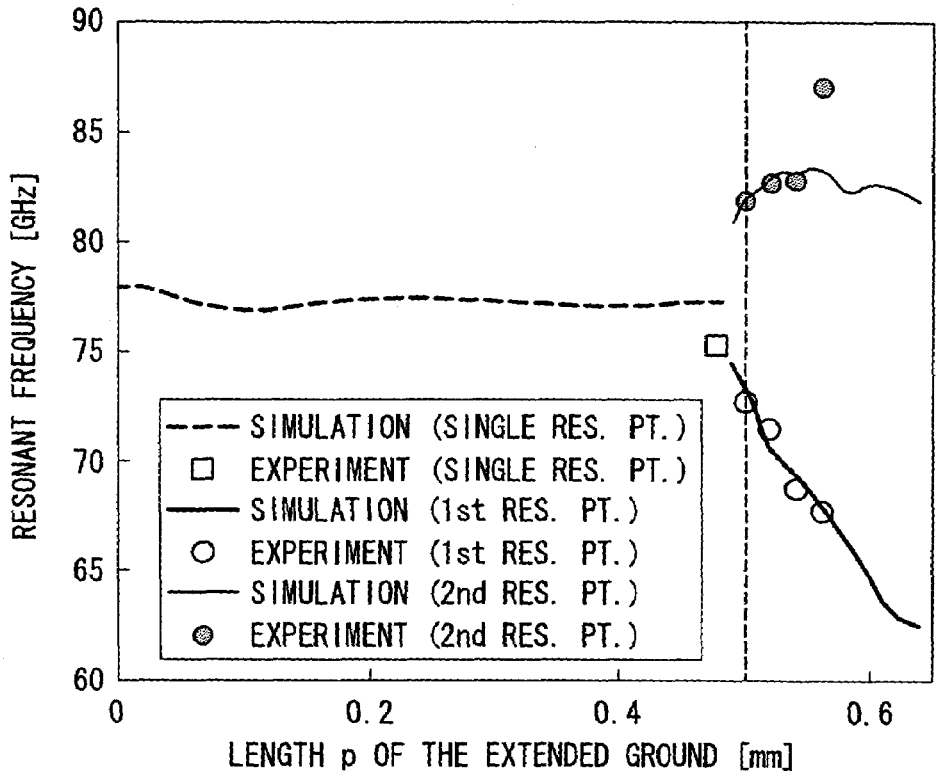
FIG. 9A shows a diagram of simulation result and measurement in an experiment regarding relationship between length of wall protrusion in a hollow space and resonance frequency in the third embodiment.
Figure 9B:
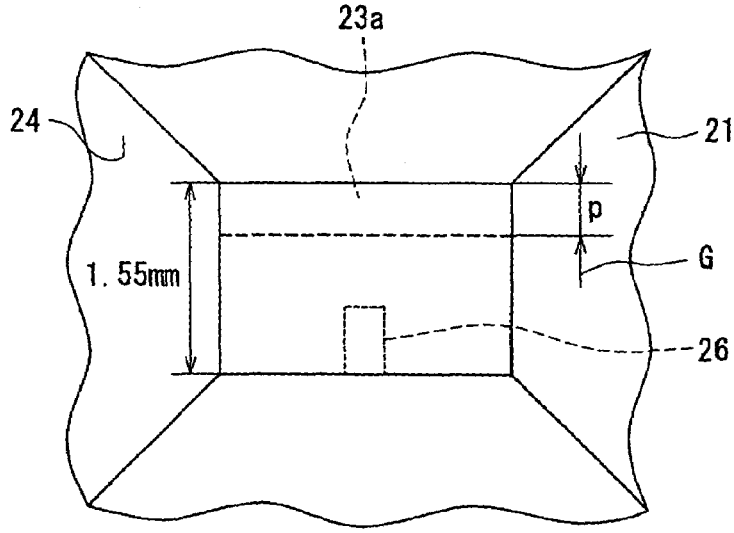
FIG. 9B shows an expanded front view of the high frequency module shown in FIG. 4A.

The amount of protrusion of the wall portion 23*a* is determined in the following manner. FIG. 9A shows a diagram of simulation result and measurement in an experiment regarding relationship between protrusion length of a wall 23*a* protruded in the hollow space 25 and resonance frequency in the third embodiment, and FIG. 9B shows an expanded front view of the high frequency module 17 shown in FIG. 4A. In this case, the shorter side of the hole 24 is 1.55 mm at the bottom, and the amount of protrusion is indicated as the length p pointed by an arrow G.

As clearly shown in FIG. 9A, two resonance points appear when the length p is in a range between 0.5 to 0.6 mm. The input/output ratio of the reflected wave has an increased frequency range of intensity lowering when the amount of protrusion p is within this range.

Figure 10:
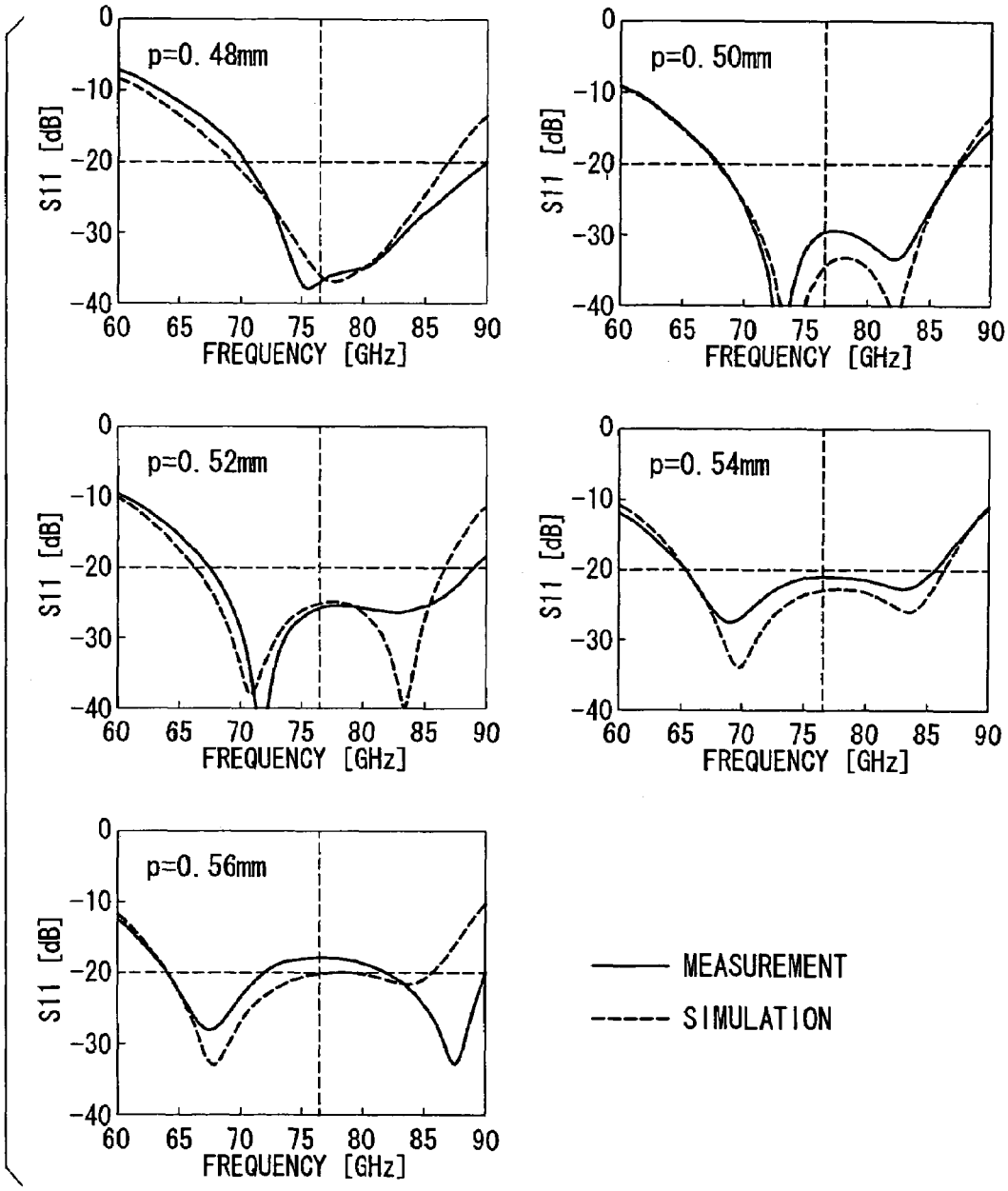
FIG. 10 shows diagrams of simulation result and measurement in an experiment regarding reflectance characteristics of the microstrip waveguide sampled at discreet amounts of the wall protrusion.

FIG. 10 shows diagrams of simulation result and measurement in an experiment regarding reflectance characteristics of the microstrip waveguide 26 sampled at discreet amounts p of the wall protrusion. As shown in the diagram in FIG. 10, the range of frequency band having the input/output ratio of under −20 dB is relatively broad when the amount p is between 0.48 mm and 0.56 mm.

As a result, the amount of wall protrusion in the hollow space 25 approximately 30 to 40% relative to the shorter side thereof serves for providing a highly efficient high frequency module 17, because of the reduction of the energy loss in reflection.

Fourth Embodiment

Figure 5A:
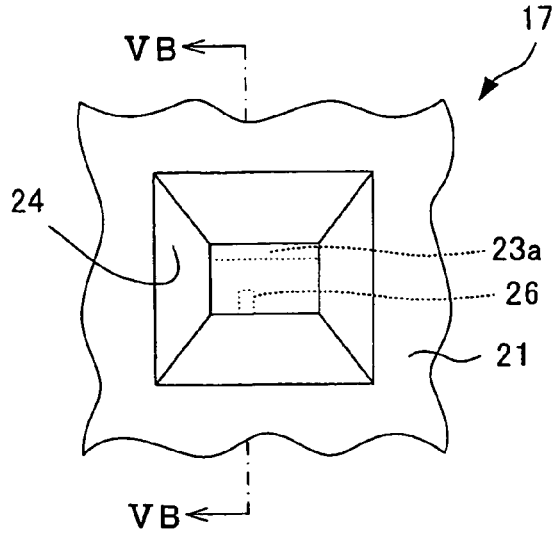
FIG. 5A shows a front view of the high frequency module in the first embodiment.
Figure 5B:
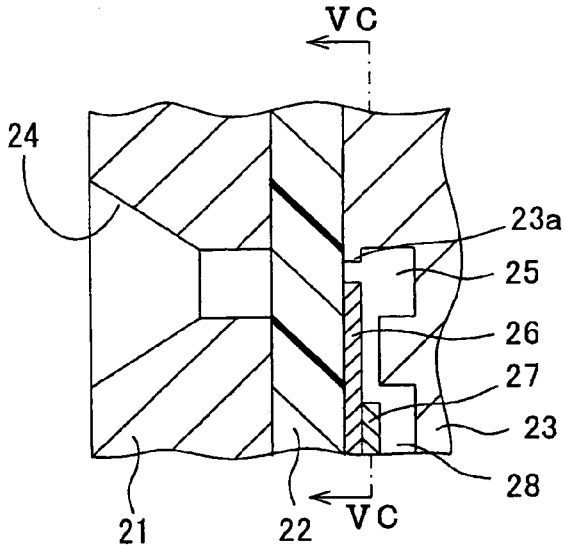
FIG. 5B shows a cross-sectional view of the high frequency module along VB-VB line in FIG. 5A in the fourth embodiment.
Figure 5C:
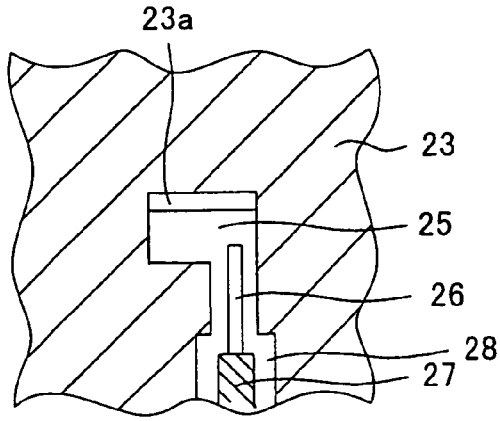
FIG. 5C shows a cross-sectional view of the high frequency module along VC-VC line in FIG. 5B. in the fourth embodiment.

A fourth embodiment of the present invention is described as a combination of the second and the third embodiments. That is, as shown in FIGS. 5A and 5B, the microstrip waveguide 26 is shifted leftward from the center of the hollow space 25 in the front view of the module 17, and the wall portion 23*a* partially covers the opening of the hollow space 25. FIG. 5C shows a cross section taken along the VC-VC line in FIG. 5B.

In this manner, the high frequency module 17 in the fourth embodiment has characteristics described in the second and third embodiments to provide a high frequency module having even higher efficiency.

Fifth Embodiment

Figure 11A:
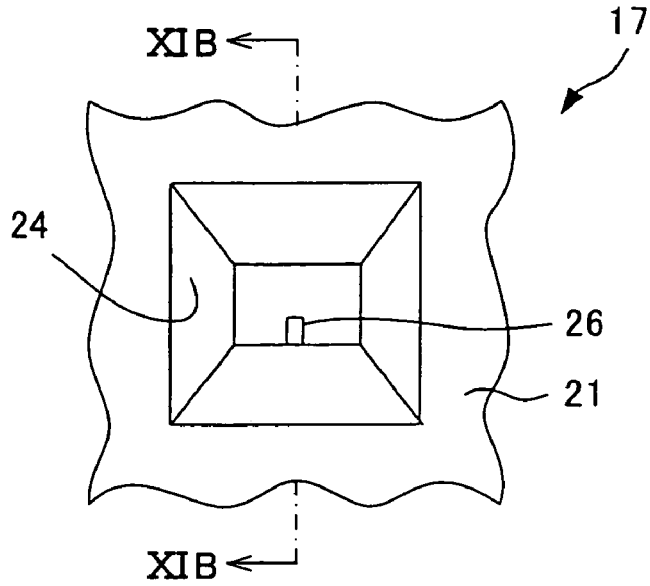
FIG. 11A shows a front view of the high frequency module in a fifth embodiment.
Figure 11B:
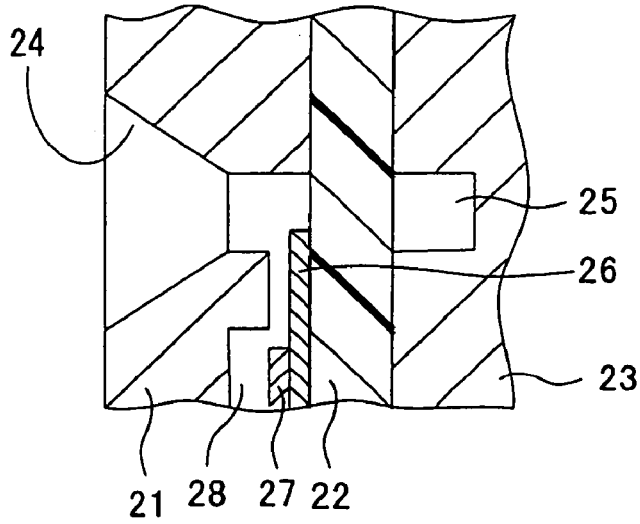
FIG. 11B shows a cross-sectional view of the high frequency module along XIB-XIB line in FIG. 11A.

A fifth embodiment of the present invention is described with reference to FIGS. 11A and 11B. In the fifth embodiment, the microstrip waveguide 26 protrudes in the hole 24. That is, as shown in the cross section in FIG. 11B the microstrip waveguide 26 may protrude in the hole 24 on the same side of the substrate 22 as the hole 24. In addition, the concavity 28 and the high frequency circuit 27 may also be disposed on the metal plate side 21.

The high frequency module 17 having the above-described structure has the same effect as the module 17 in the first embodiment.

Other Embodiment

Although the present invention has been fully described in connection with the preferred embodiment thereof with reference to the accompanying drawings, it is to be noted that various changes and modifications will become apparent to those skilled in the art.

For example, the high frequency module 17 is used to capture and convert the high frequency wave radiated from the detecting object to the high frequency wave in the planar waveguide in the embodiments described above. That is, the module 17 is used to receive the high frequency wave in the above embodiments. However, the high frequency module 17 may be used to transmit the high frequency wave.

Such changes and modifications are to be understood as being within the scope of the present invention as defined by the appended claims.

What is claimed is:

1. A high frequency module for converting high frequency wave in a free space to high frequency wave in a planar waveguide, the high frequency module comprising:

two metal plates;

a dielectric substrate; and a planar waveguide disposed on the dielectric substrate, wherein the dielectric substrate is positioned between the two metal plates, one of the two metal plates has a through hole, the planar waveguide disposed on the dielectric substrate on one side that faces the other of the two metal plates, and one of two ends of the planar waveguide is positioned in a projection area of the through hole projected substantially in an axial direction of the through hole onto the dielectric substrate.

2. The high frequency module according to claim 1, wherein the planar waveguide is a microstrip waveguide, and one of two ends of the microstrip waveguide protrudes in a sweep space of the projection area of the through hole virtually performed in the axial direction of the through hole toward the dielectric substrate.

3. The high frequency module according to claim 2, wherein positioning of the microstrip waveguide is defined by displacement of the one of the two ends of the microstrip waveguide from a center axis of the sweep space by a predetermined amount, a direction of the displacement of the microstrip waveguide is perpendicular to a longitudinal direction of the microstrip waveguide, and the microstrip waveguide is kept in parallel with the dielectric substrate after the displacement.

4. The high frequency module according to claim 3, wherein an amount of the displacement of the microstrip waveguide is approximately 10 to 15% of an inside dimension of the sweep space measured in a direction of the displacement.

5. The high frequency module according to claim 1, wherein an inside dimension of the through hole measured in parallel with the dielectric substrate increases as position of the measurement defined from the dielectric substrate increases toward an opening of the through hole, and an increase of the inside dimension of the through hole starts at a predetermined position of the through hole.

6. The high frequency module according to claim 1, wherein the other of the two metal plates defines a hollow space having an opening covered by the dielectric substrate, and the opening of the hollow space on the dielectric substrate corresponds to the projection area of the through hole positioned in a plane symmetric manner relative to the dielectric substrate as an axial plane.

7. The high frequency module according to claim 6, wherein a cross section of the through hole and a cross section of the hollow space both taken in parallel with the dielectric substrate are in a same rectangular shape and in a same size, and a shorter side of the rectangular shape is aligned with the longitudinal direction of the planar waveguide.

8. The high frequency module according to claim 6, the opening of the hollow space has a wall portion that extends along the dielectric substrate in an opposite direction relative to a protrusion direction of the planar waveguide, the wall portion is attached on an opposite side of the hollow space relative to the planar waveguide, and the wall portion partially covers the opening of the hollow space.

9. The high frequency module according to claim 8, wherein an amount of extension of the wall portion is substantially 30 to 40% of a shorter side of a rectangular shape of the opening defined on a surface of the dielectric substrate.

10. The high frequency module according to claim 1 further comprising: a high frequency circuit having a wave detection function, wherein the high frequency circuit is connected to the other of the two ends of the planar waveguide.

11. An array of the high frequency modules according to claim 1, wherein an opening of the through hole on each of the high frequency modules in the array is directed toward a predetermined direction.

12. The array of the high frequency modules according to claim 11, wherein a convex dielectric lens in a proximity of the openings of the through holes of the high frequency modules covers the predetermined direction relative to the array of the high frequency modules.

13. A high frequency module for converting high frequency wave in a free space to high frequency wave in a planar waveguide, the high frequency module comprising:

two metal plates;

a dielectric substrate; and a planar waveguide disposed on the dielectric substrate, wherein the dielectric substrate is positioned between the two metal plates, one of the two metal plates has a through hole, the planar waveguide disposed on the dielectric substrate on one side that faces the one of the two metal plates, and one of two ends of the planar waveguide is positioned in a projection area of the through hole projected substantially in an axial direction of the through hole onto the dielectric substrate.

14. The high frequency module according to claim 13, wherein the planar waveguide is a microstrip waveguide, and one of two ends of the microstrip waveguide protrudes in the through hole.

15. The high frequency module according to claim 14, wherein positioning of the microstrip waveguide is defined by displacement of the one of the two ends of the microstrip waveguide from a center axis of the through hole by a predetermined amount, a direction of the displacement of the microstrip waveguide is perpendicular to a longitudinal direction of the microstrip waveguide, and the microstrip waveguide is kept in parallel with the dielectric substrate after the displacement.

16. The high frequency module according to claim 15, wherein an amount of the displacement of the microstrip waveguide is approximately 10 to 15% of an inside dimension of the through hole measured in a direction of the displacement.

* * * * *